US006915721B2

(12) United States Patent
Hsu et al.

(10) Patent No.: US 6,915,721 B2
(45) Date of Patent: Jul. 12, 2005

(54) CORDLESS RATCHET WRENCH

(75) Inventors: Chih-Hua Hsu, Taichung (TW); Yu-Min Su, Taichung (TW); Chen-Chen Cheng, Taichung (TW)

(73) Assignee: Techway Industrial Co., Ltd., Taichung (TW)

( * ) Notice: Subject to any disclaimer, the term of this patent is extended or adjusted under 35 U.S.C. 154(b) by 54 days.

(21) Appl. No.: 10/691,373

(22) Filed: Oct. 22, 2003

(65) Prior Publication Data

US 2005/0090216 A1 Apr. 28, 2005

(51) Int. Cl.[7] ..... B25B 21/00
(52) U.S. Cl. ..... 81/57.13; 81/57.29
(58) Field of Search ..... 81/57.13, 57.29, 81/57.3, 57.11, 60, 61, 62, 63, 63.1, 63.2

(56) References Cited

U.S. PATENT DOCUMENTS 4,974,475 A 12/1990 Lord et al.
5,231,901 A * 8/1993 Putney et al. ..... 81/57.39
6,311,583 B1 * 11/2001 Izumisawa ..... 81/57.13
6,715,380 B2 * 4/2004 Listl et al. ..... 81/57.13

FOREIGN PATENT DOCUMENTS

JP 2004 10616 1 4/2004

* cited by examiner

*Primary Examiner*—Jacob K. Ackun, Jr.
(74) *Attorney, Agent, or Firm*—Greer, Burns & Crain, Ltd.

(57) ABSTRACT

An electrical ratchet wrench has a body, a motor, a battery set, a switch, a planet gear assembly, a connecting collar, a head and a ratcheting device. The motor is received in the body and has an output shaft with a pinion. The battery set is detachably received in the body and is electrically connected to the motor. The switch is electrically connected between the motor and the battery set. The planet gear assembly is received in the body and has a rotating base, a stub, multiple planet gears and a stationary collar. The connecting collar securely holds the stationary collar in the connecting collar. The ratcheting device is received in the head for driving a fastener to rotate and has a driven shaft connected to the stub on the rotating base. Accordingly, a cordless electrical ratchet wrench is provided and is convenient in use.

18 Claims, 4 Drawing Sheets

CORDLESS RATCHET WRENCH

BACKGROUND OF THE INVENTION

1. Field of the Invention

The present invention relates to a wrench, and more particularly to a cordless electrical ratchet wrench that has a battery set and is convenient in use.

2. Description of Related Art

Wrenches are widely used for fastening or releasing a fastener, such as a bolt or a nut. To drive the wrench to operate, manual power, compressed air or electrical power is commonly used. With a pneumatic or an electrical wrench, the fastener can be tightened or loosened rapidly and conveniently.

However, the conventional pneumatic or electrical wrench must be connected to a power source, and to transport the power source is frequently inconvenient, and sometimes even impossible. Therefore, the conventional pneumatic or electrical wrench cannot be used in a location far away from the power source, for example outdoors. Thus, the use of the conventional pneumatic or electrical wrench is inconvenient.

To overcome the shortcomings, the present invention tends to provide a wrench to mitigate or obviate the aforementioned problems.

SUMMARY OF THF INVENTION

The main objective of the invention is to provide an electrical ratchet wrench that has a battery set so that the wrench is cordless and is convenient in use at any desired location. The electrical ratchet wrench has a body, a motor, a battery set, a switch, a planet gear assembly, a connecting collar, a head and a ratcheting device. The body is composed of two half shells each having an outer side and an inner side. The motor is received in the body and has an output shaft with a pinion. The battery set is detachably received in the body and is electrically connected to the motor. The switch is electrically connected between the motor and the battery set. The planet gear assembly is received in the body and has a rotating base, a stub, multiple planet gears and a stationary collar. The connecting collar is attached to one end of the body and securely holds the stationary collar in the connecting collar. The head is attached to the connecting collar. The ratcheting device is received in the head for driving a fastener to rotate and has a driven shaft extending into and engaging with the engaging hole in the stub on the rotating base. Accordingly, a cordless electrical ratchet wrench is provided and is convenient in use.

Other objects, advantages and novel features of the invention will become more apparent from the following detailed description when taken in conjunction with the accompanying drawings.

BRIEF DESCRIPTION OF THE DRAWINGS

FIG. 3 is an exploded perspective view of a second embodiment of an electrical ratchet wrench in accordance with the present invention; and.

DETAILED DESCRIPTION OF PREFERRED EMBODIMENT

Figure 1:
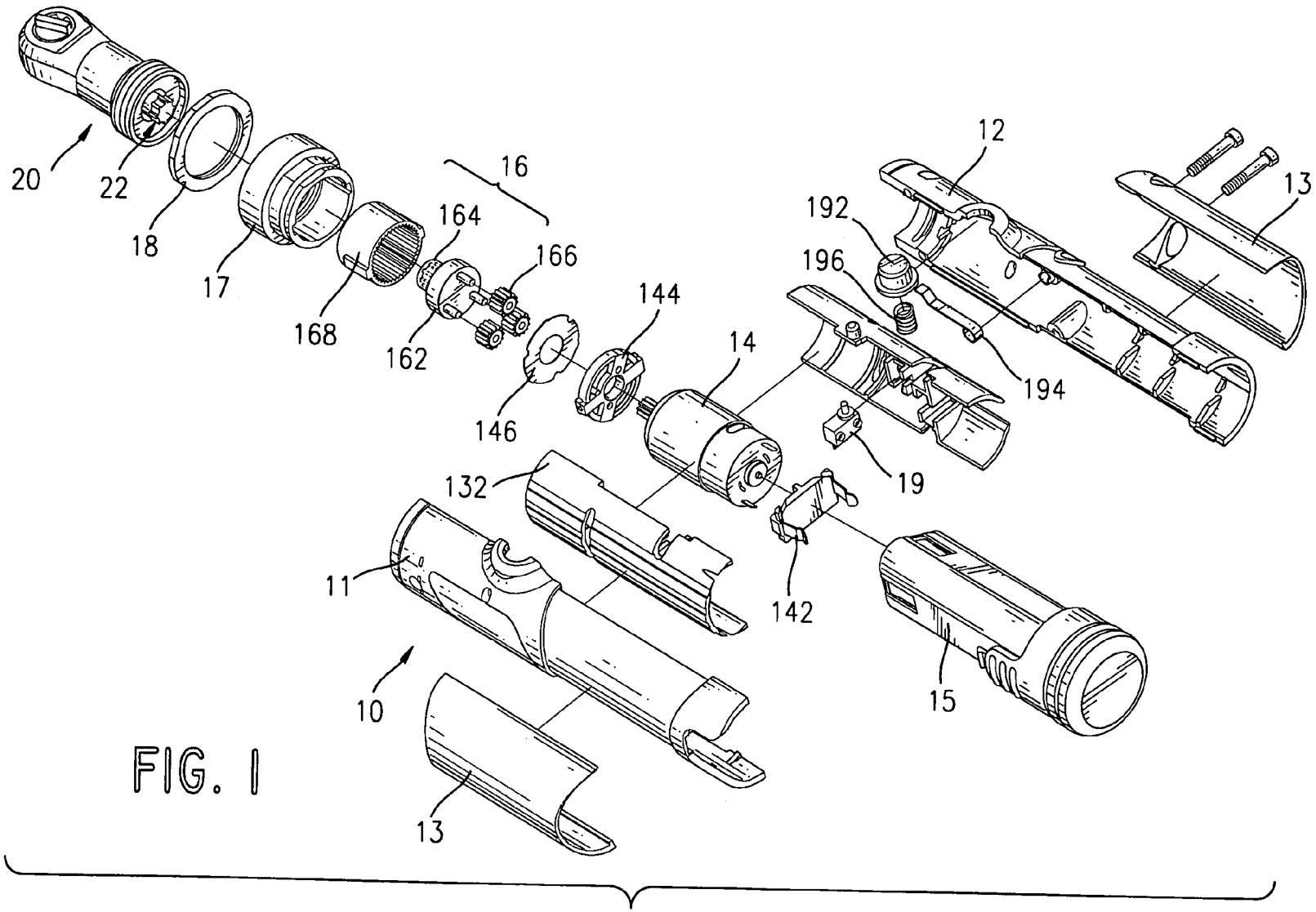
FIG. 1 is an exploded perspective view of a first embodiment of an electrical ratchet wrench in accordance with the present invention.
Figure 2:
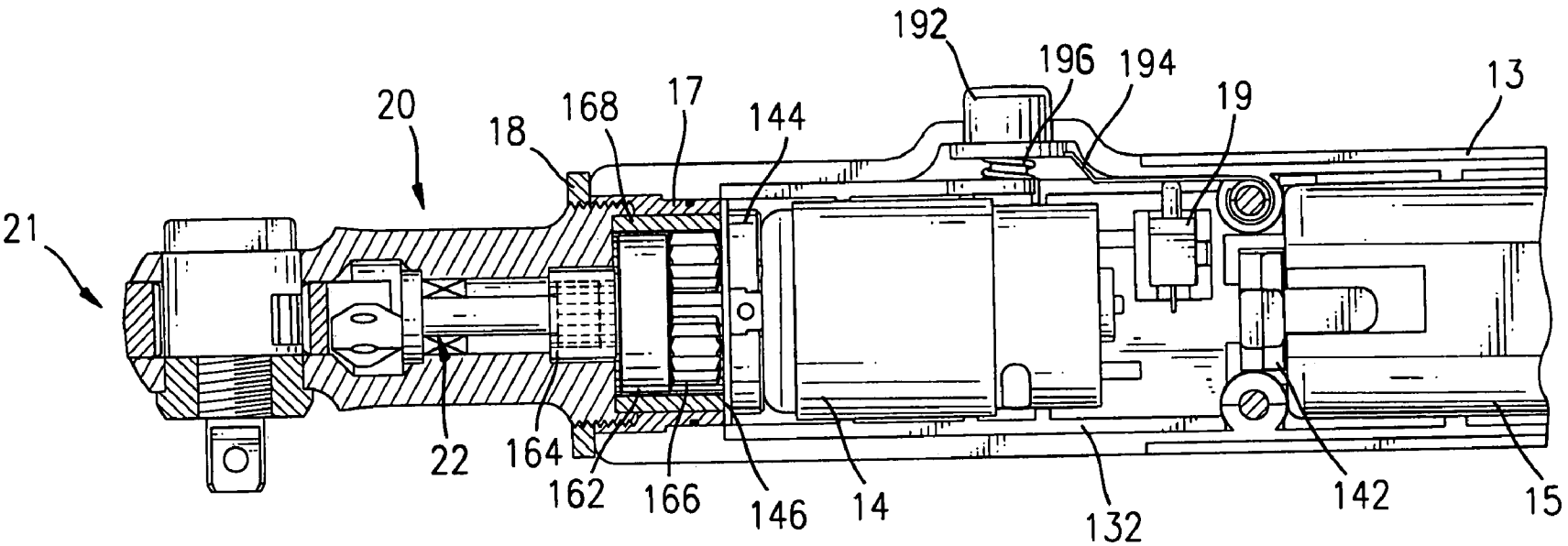
FIG. 2 is a side plan view in partial section of the ratchet wrench in FIG. 1.

With reference to FIGS. 1 and 2, an electrical ratchet wrench in accordance with the present invention comprises a body (10), a motor (14), a battery set (15), a switch (19), a planet gear assembly-(16), a connecting collar (17), a head (20) and a ratcheting device (21). The body (10) is composed of two half shells (11,12) and optionally has two outer covers (13) and two inner holders (132). Each shell (11,12) has an outer side and an inner side. In an optional embodiment, the half shells (11,12) are combined together by fasteners (not numbered), such as screws. The two optional outer covers (13) are attached respectively to the outer sides of the half shells (11,12). The inner holders (132) are made of an insulating material and are attached respectively to the inner sides of the half shells (11,12).

The motor (14) is received in the body (10) and is optionally received and held between the inner holders (132). The motor (14) has an output shaft (not numbered) with a pinion (not numbered). In an optional embodiment, a holding base (144) is received in the body (10) to support the output shaft of the motor (14).

The battery set (15) is detachably received in the body (10) and is electrically connected to the motor (14). In a preferred embodiment, the battery set (15) is rechargeable. The ratchet wrench may have an adapter (142) with two contacting legs (not numbered) received in the body (10) to electrically contact with two electrodes (not numbered) of the battery set (15).

The switch (19) is electrically connected between the motor (14) and the adapter (142) that is connected to the battery set (15). In an optional embodiment, the switch (19) is received in the body (10), and the wrench further has a button (192), a resilient strip (194) and a biasing member (196). The button (192) is attached between and exposed from the half shells (11,12) of the body (10). The resilient strip (194) is received in the body (10) and has two ends connected respectively to the button (192) and the switch (19). The biasing member (196) is received in the body (10) to support the button (192) and optionally is a spring. When the button (192) is pushed, the switch (19) is switched by the transmission of the resilient strip (194). Accordingly, the electrical power provided by the battery set (15) will be supplied to the motor (14) or will be cut off from the motor (14). In an alternative embodiment, the switch (19) is exposed from the body (10) and is pushed directly by a user.

The planet gear assembly (16) is received in the body (10) and comprises a rotating base (162), a stub (164), multiple planet gears (166) and a stationary collar (168). The rotating base (162) is rotatably received in the body (10) and has a first side and a second side. The stub (164) protrudes from the first side of the rotating base (162) and has a distal end and an engaging hole (not numbered) defined in the distal end. The planet gears (166) are rotatably attached oh the second side of the rotating base (162) and engage with the pinion on the output shaft of the motor (14). The stationary collar (168) is securely held in the body (10) and has an outer surface and an inner gear (not numbered) engaging with the planet gears (166).

Accordingly, when the switch (19) is switched on, the electrical power provided by the battery set (15) will be supplied to the motor (14) to drive the output shaft to rotate.

With the engagement between the planet gears (166) and the inner gear in the stationary collar (168), the rotating base (162) will be driven to rotate.

In an optional embodiment, a gasket (146) is mounted around the output shaft and is located between the planet gears (166) of the planet gear assembly (16) and the holding base (144) to keep the planet gears (166) from touching the holding base (144).

The connecting collar (17) is attached to one end of the body (10) and securely holds the stationary collar (168) in the connecting collar (17). The connecting collar (17) has an inner surface. To securely hold the stationary collar (168) in the connecting collar (17), two ribs (not numbered) are longitudinally formed on the outer surface of the stationary collar (168). The connecting collar (17) has two recesses (not numbered) defined in the inner surface to respectively receive the ribs on the stationary collar (168). With the engagements of the ribs and the corresponding recesses, the stationary collar (168) will not rotate relative to the connecting collar (17).

The head (20) is attached to the connecting collar (17) to be securely held at one end of the body (10). In an optional embodiment, the head (20) has an outer thread (not numbered), and the connecting collar (17) has an inner thread (not numbered) screwing with the outer thread on the head (20). The ratchet wrench may have a positioning ring (18) mounted around the head (20) and abutting against one end of the body (10). The positioning ring (18) has an inner thread (not numbered) screwing with the outer thread on the head (20).

The ratcheting device (21) is received in the head (20) for driving a fastener to rotate and has a driven shaft (22) extending into and engaging with the engaging hole in the stub (164) on the rotating base (162). The detailed structure of the ratcheting device (21) is substantially the same as that of a conventional one and is not an essential part of the present invention, so the detailed structure of the ratcheting device (21) is not further described.

Accordingly, when the switch (19) is switched on, the rotating base (162) will be driven to rotate relative to the body (10). The driven shaft (22) will be driven to rotate, and the ratcheting device (21) is driven to operate to rotate a fastener or a tool head connected to the ratcheting device (21). Consequently, a cordless electrical ratchet wrench is provided, and the ratchet wrench in accordance with the present invention can be taken to any desired place for work. When the battery set (15) is out of power, a new battery set can be fitted to keep the ratchet wrench working. With a rechargeable battery set (15), the battery set (15) can be recharged when the battery set (15) is out of power. The use of the cordless electrical ratchet wrench in accordance with the present invention is convenient in use.

Figure 3:
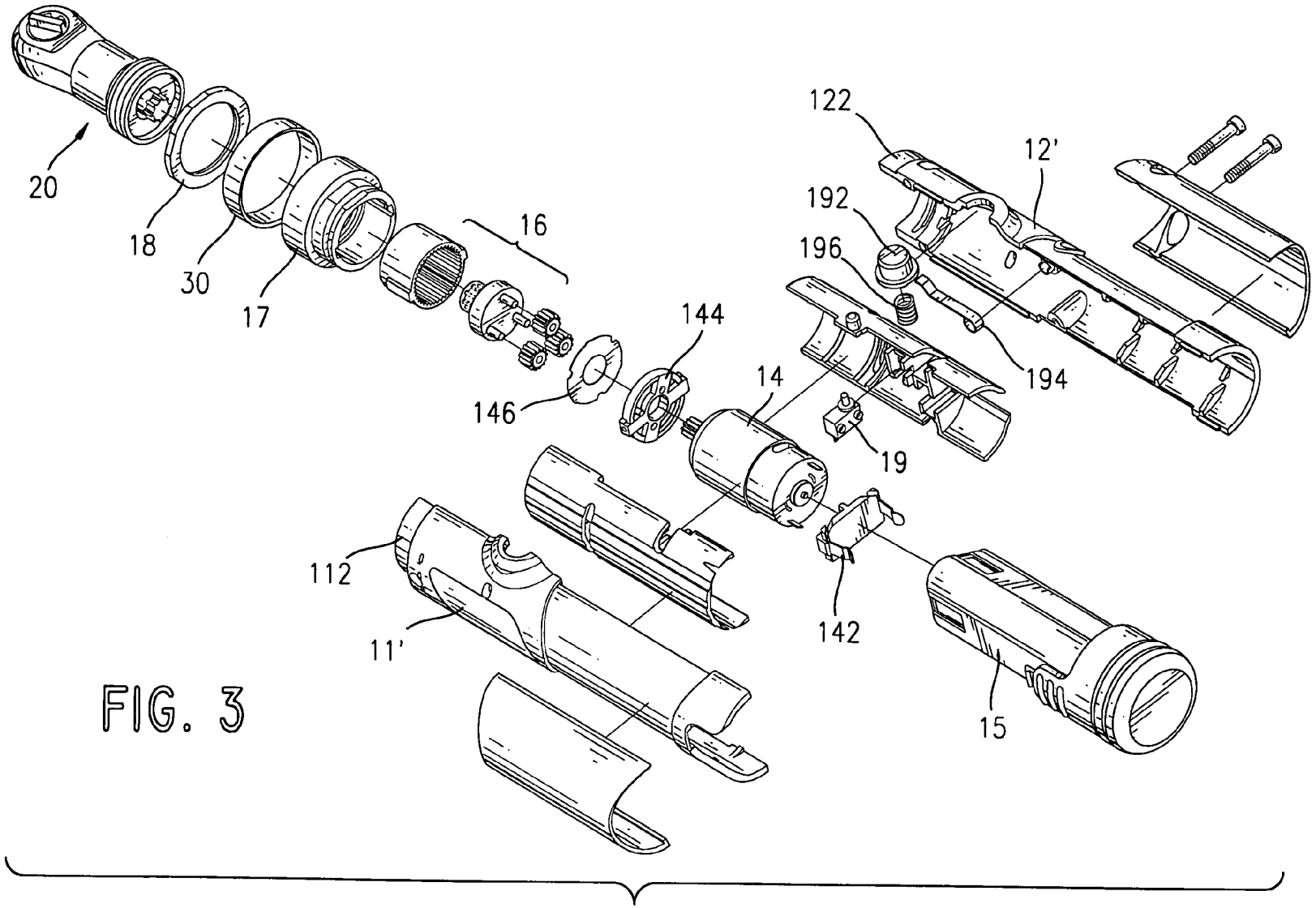

With reference to FIG. 3, a second embodiment of a ratchet wrench in accordance with the present invention has a structure the same as the first embodiment previously described except that each half shell (11',12') has a neck (112,122) protruding from the half shell (11',12') at the end to which the head (20) is attached. A holding ring (18) is mounted around the necks (112,122) on the half shells (11',12'). With the arrangement of the holding ring (18), the combination between the half shells (11',12') is improved.

Figure 4:
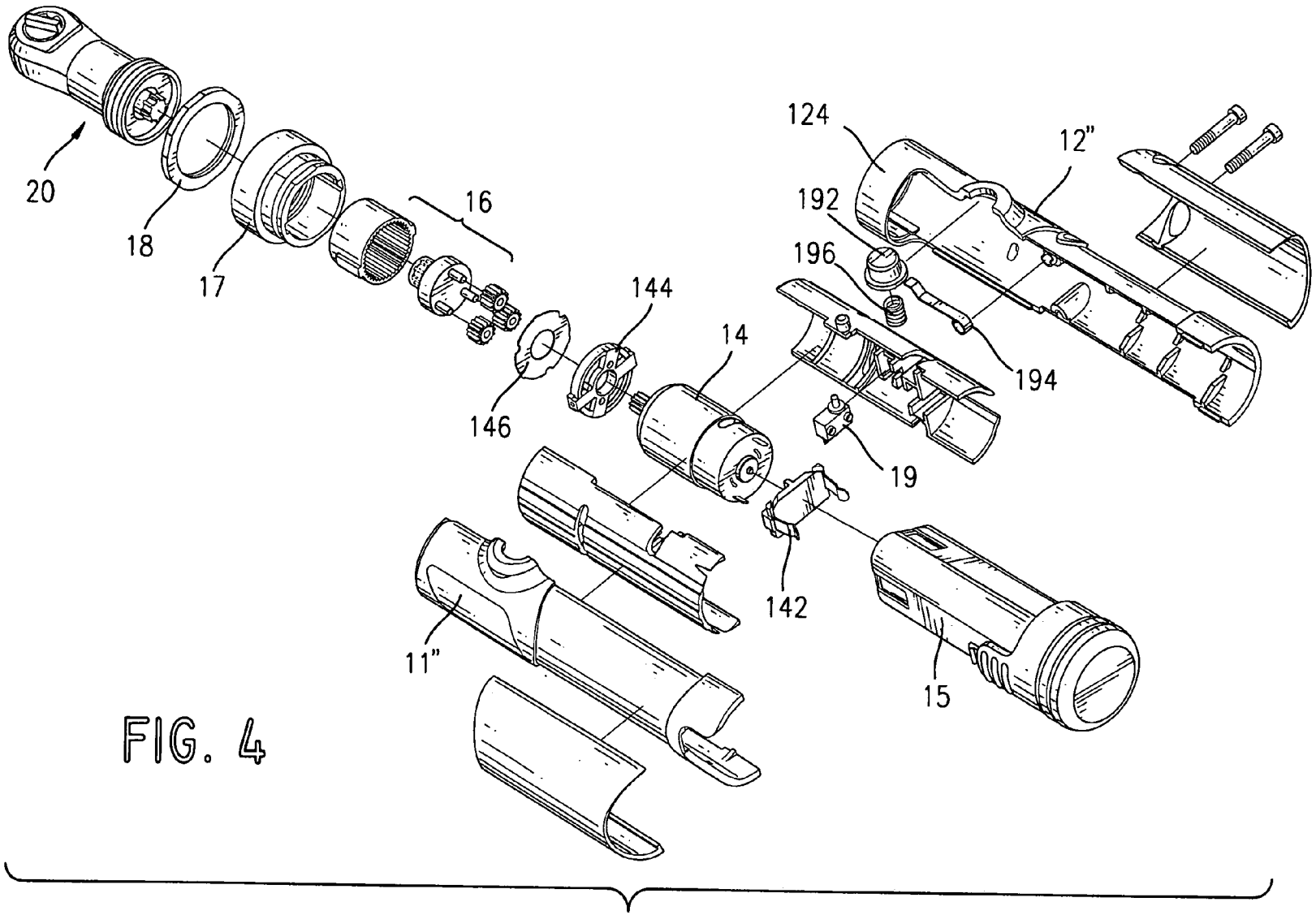
FIG. 4 is an exploded perspective view of a third embodiment of an electrical ratchet wrench in accordance with the present invention.

With reference to FIG. 4, a third embodiment of a ratchet wrench in accordance with the present invention has a structure the same as the first embodiment previously described except that one of the half shells (12") has an annular neck (124) formed on the half shell (12") at the end to which the head (20) is attached. The half shell (12") with the neck (124) has a length longer than that of the other half shell (11").

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical ratchet wrench comprising:

a body composed of two shells each having an outer side and an inner side;

a motor received in the body and having an output shaft with a pinion;

a battery set detachably received in the body and electrically connected to the motor;

a switch electrically connected between the motor and the battery set;

a planet gear assembly received in the body and comprising a rotating base rotatably received in the body and having a first side and a second side;

a stub protruding from the first side and having a distal end and an engaging hole defined in the distal end;

multiple planet gears rotatably attached on the second side of the rotating base and engaging with the pinion on the output shaft of the motor; and a stationary collar securely held in the body and having an outer surface and an inner gear engaging with the planet gears;

a connecting collar with an inner surface attached to one end of the body and securely holding the stationary collar in the connecting collar;

a head attached to the connecting collar; and a ratcheting device received in the head for driving a fastener to rotate and having a driven shaft extending into and engaging with the engaging hole in the stub on the rotating base.

2. The ratchet wrench as claimed in claim 1 further comprising two outer covers attached respectively to the outer sides of the shells; and two inner holders made of an insulating material and attached respectively to the inner sides of the shells to enclose and to hold the motor.

3. The ratchet wrench as claimed in claim 2, wherein the switch is received in the body;

a button is attached between and exposed from the shells of the body;

a resilient strip is received in the body and has two ends connected respectively to the button and the switch; and a biasing member is received in the body to support the button.

4. The ratchet wrench as claimed in claim 3, wherein the stationary collar has two ribs longitudinally formed on the outer surface of the stationary collar; and the connecting collar has two recesses defined in the inner surface to respectively receive the ribs on the stationary collar.

5. The ratchet wrench as claimed in claim 4 further comprising a holding base received in the body to support the output shaft of the motor.

6. The ratchet wrench as claimed in claim 5 further comprising a gasket mounted around the output shaft and located between the planet gears of the planet gear assembly and the holding base to keep the planet gears from touching the holding base.

7. The ratchet wrench as claimed in claim 6 further comprising a positioning ring mounted around the head and abutting against one end of the body.

8. The ratchet wrench as claimed in claim 7, wherein each shell has a neck protruding from the shell at the end to which the head is attached; and a holding ring is mounted around the necks on the shells.

9. The ratchet wrench as claimed in claim 7, wherein one of the shells has an annular neck formed on the shell at the end to which the head is attached; and the shell with the neck has a length longer than that of the other shell.

10. The ratchet wrench as claimed in claim 7, wherein the head has an outer thread;

the connecting collar has an inner thread screwing with the outer thread on the head; and the positioning ring has an inner thread screwing with the outer thread on the head.

11. The ratchet wrench as claimed in claim 1, wherein the switch is received in the body;

a button is attached between and exposed from the shells of the body;

a resilient strip is received in the body and has two ends connected respectively to the button and the switch; and a biasing member is received in the body to support the button.

12. The ratchet wrench as claimed in claim 1, wherein the stationary collar has two ribs longitudinally formed on the outer surface of the stationary collar; and the connecting collar has two recesses defined in the inner surface to respectively receive the ribs on the stationary collar.

13. The ratchet wrench as claimed in claim 1 further comprising a holding base received in the body to support the output shaft of the motor.

14. The ratchet wrench as claimed in claim 13 further comprising a gasket mounted around the output shaft and located between the planet gears of the planet gear assembly and the holding base to keep the planet gears from touching the holding base.

15. The ratchet wrench as claimed in claim 1 further comprising a positioning ring mounted around the head and abutting against one end of the body.

16. The ratchet wrench as claimed in claim 15, wherein the head has an outer thread;

the connecting collar has an inner thread screwing with the outer thread on the head; and the positioning ring has an inner thread screwing with the outer thread on the head.

17. The ratchet wrench as claimed in claim 1, wherein each shell has a neck protruding from the shell at the end to which the head is attached; and a holding ring is mounted around the necks on the shells.

18. The ratchet wrench as claimed in claim 1, wherein one of the shells has an annular neck formed on the shell at the end to which the head is attached; and the shell with the neck has a length longer than that of the other shell.

* * * * *